United States Patent [19]

Ware

[11] Patent Number: 5,044,419

[45] Date of Patent: Sep. 3, 1991

[54] HOLLOW POST CYLINDRICAL SPRUE CASTING METHOD

[75] Inventor: Maximillian Ware, Minneapolis, Minn.

[73] Assignee: Kirchner Corporation, Minneapolis, Minn.

[21] Appl. No.: 489,542

[22] Filed: Mar. 7, 1990

[51] Int. Cl.[5] ..... B22C 7/02; B22C 9/04

[52] U.S. Cl. ..... 164/34; 164/45

[58] Field of Search ..... 164/34, 35, 36, 45

[56] References Cited

U.S. PATENT DOCUMENTS

| | | | |
|---|---|---|---|
| 3,186,041 | 1/1965 | Horton | 164/36 |
| 3,648,760 | 3/1972 | Cooper | 164/35 |

FOREIGN PATENT DOCUMENTS

| | | | |
|---|---|---|---|
| 2554070 | 6/1977 | Fed. Rep. of Germany | 164/45 |
| 54-157728 | 12/1979 | Japan | 164/45 |
| 60-206550 | 10/1985 | Japan | 164/45 |
| 88009901 | 3/1988 | Japan | 164/45 |
| 0759203 | 8/1980 | U.S.S.R. | 164/35 |

OTHER PUBLICATIONS

Preci-Roto, Versatile System . . . , Nov. 1981.

*Primary Examiner*—Richard K. Seidel
*Assistant Examiner*—Rex E. Pelto
*Attorney, Agent, or Firm*—Oblon, Spivak, McClelland, Maier & Neustadt

[57] ABSTRACT

A method of forming a hollow cylindrical tube from wax such that a taper exists from one end to the other resulting in different wall thicknesses at either end of the tube, mounting said tube in a vertical position onto a semi-flexible base such that the end of the tube with the greatest wall thickness is in contact with the base, and attaching individual jewelry patterns onto the outside surface of the tube prior to encapsulation by an investment, which is one of the steps in the lost wax casting process of jewelry manufacture.

6 Claims, 4 Drawing Sheets

HOLLOW POST CYLINDRICAL SPRUE CASTING METHOD

BACKGROUND OF THE INVENTION

1. Field of the Invention

The present invention relates to a method of preparing shaped hollow wax tubes and using said tubes as central mounting posts for the attachment of wax or plastic jewelry patterns prior to encapsulation in a plaster bonded ceramic material known as investment which is a step in the lost wax casting process of jewelry manufacture.

Background of the Prior Art

One technique for assembling numerous individual jewelry patterns fashioned of wax or plastic, into a single unified structure, is a process known to the industry as "treeing". In this process, a single solid wax or plastic rod or post, is positioned by inserting one end into a semi-flexible base such that the post, is perpendicular to the base and is in a vertical position, when the base is placed on a horizontal surface. Individual jewelry patterns, consisting of a model of a piece of jewelry which is desired and to which is attached a sprue or mounting post, and which have been previously cast or molded of wax or plastic, are mounted in a radial fashion along the length of the post. Mounting of the pattern sprues to the post is accomplished with a hand held heated spatula which temporarily melts both a small section of the post and the end of the pattern sprue thus permitting a co-mingling of molten materials when the two are placed into contact. Cooling of the molten areas on the pattern sprue and post result in a permanent attachment of the pattern sprue to the post in a relative position determined by the orientation of the pattern sprue to the post immediately prior to and during the cooling period.

The resemblance of the post to a "trunk" and the radially positioned jewelry patterns to "limbs", have resulted in general industry terminology of "treeing" which is the act of positioning and attaching jewelry patterns to a central post or trunk, and "tree" which is the subsequent central post or trunk to which jewelry patterns have been attached. The central element in the tree to which jewelry patterns have been attached will hereon be referred to as the "trunk".

Positioning of the individual jewelry patterns around the trunk is desired such that no contact between patterns is made. When all available space around the trunk is occupied by patterns, the resulting tree as positioned and attached to the semi-flexible base, is ready for encapsulation by a liquid plastic bonded ceramic material known to the industry as "investment".

In the operation of investing, an iron or steel thin walled hollow cylinder known as a flask and whose height is generally one to two times its diameter, is positioned onto the semi-flexible base in such a manner that the cylinder forms a liquid tight seal with the base while surrounding and extending beyond the height of the tree. A liquid plaster bonded ceramic material is prepared and poured into the flask such that the liquid plaster completely surrounds and encapsulates the tree. The plaster hardens and the semi-flexible base is removed from the flask, plaster, and tree, such that the tree remains embedded within the plaster. Any of several methods utilizing heat, are then employed to melt and remove the tree from the plaster such that a cavity which is an exact duplication of the tree geometry is then used in a process whereby a molten precious metal is introduced to the cavity by centrifugal or vacuum casting methods. Subsequent cooling of the molten metal results in a cast geometrical duplication of the tree, its trunk and attached jewelry patterns. The flask is removed from the plaster, which is then broken and removed from around the tree and jewelry castings. The jewelry castings are then removed from the trunk for subsequent processing.

Although beyond the immediate scope of this invention, a description of the investing and metal casting processes are included since the geometry of the tapered hollow cylindrical tube of the present invention, as the trunk of the tree, influences subsequent investing and casting processes.

SUMMARY OF THE INVENTION

Accordingly, one object of the present invention is to provide a method to increase the number of individual patterns that can be attached to a trunk during the process of treeing.

Another object of the present invention is to provide a method of manufacturing hollow cylindrical tubes of wax or plastic with tapering wall thickness that will be used as the trunk in the process of treeing.

Another object of the present invention is a method of positioning and attachment of a hollow cylindrical tube to a base.

Briefly, these objects and other objects of the present invention as hereinafter described will become more readily apparent can be attained by a method of forming wax or plastic tubes with changing wall thickness accomplished by tapering the inside or outside diameters of the tube, and mounting the appropriately shaped tubes onto a suitably shaped semi-flexible base prior to the attachment of individual jewelry patterns to the tubes in a radial pattern along the length of the tube. This process is hereafter referred to as the Hollow Post Cylindrical Sprue Casting Method.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1A:
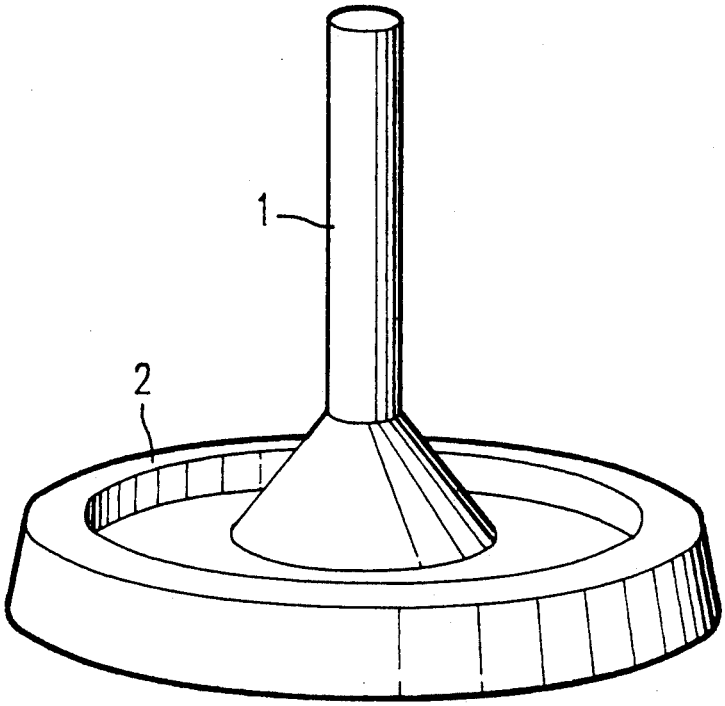
FIG. 1 *(a,b)* is a perspective and cross sectional view of a traditional configuration of a solid cylindrical wax trunk positioned into a semi-flexible base.
Figure 1B:
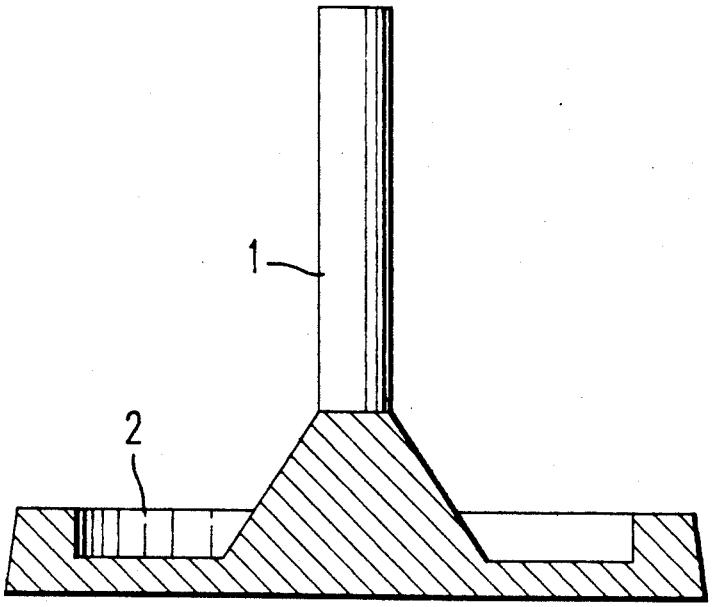

Utilization of the present invention can allow an increase in the number of jewelry patterns which may be attached to a central element or trunk of a tree when compared with a traditional method shown in FIG. 1, since a hollow cylinder which has a diameter 3 to 4 times greater than a solid cylindrical rod will have a correspondingly greater exterior surface area onto which patterns may be attached. It may be correctly concluded that the external surface are of a large solid cylindrical rod will allow the attachment of an equal number of patterns as with a hollow cylindrical tube, however, the use of a large diameter solid trunk will be practicably precluded from use due to a resulting and unacceptably large volume of precious metal within the cavity corresponding to the trunk itself. A large ratio in the volume of metal within the trunk to volume of metal within the jewelry castings necessarily limits the capacity of an existing casting apparatus, requires utilization of a larger casting apparatus for the increased metal weight and/or volume, results in increased metal refinement costs with the remelting and recycling of the metal trunk. Thus, in an effort to minimize the adverse effects of a large diameter solid trunk, an object of the present invention is proposed, a hollow and tapered cylinder.

Figure 2A:
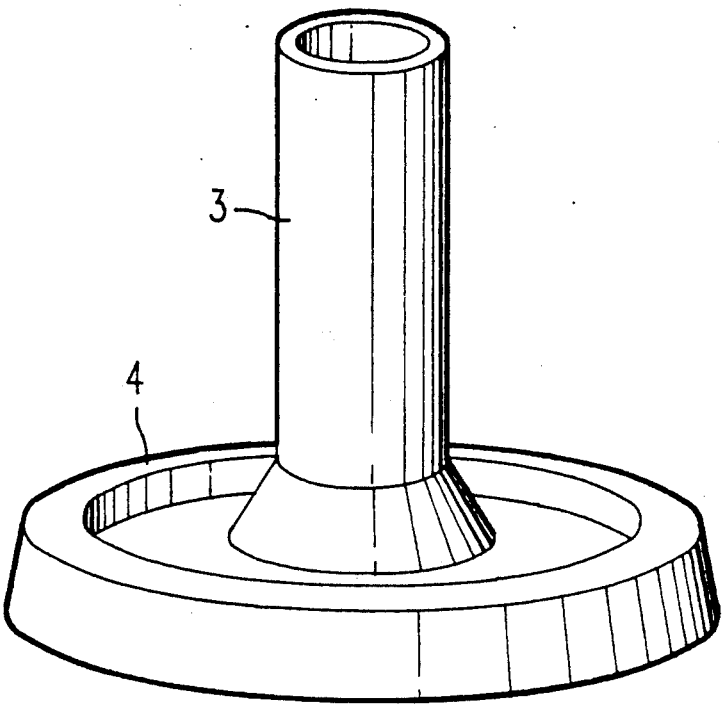
FIG. 2 *(a,b)* is a perspective and cross sectional view of a tapered hollow cylindrical tube mounted onto a semi-flexible rubber base.
Figure 2B:
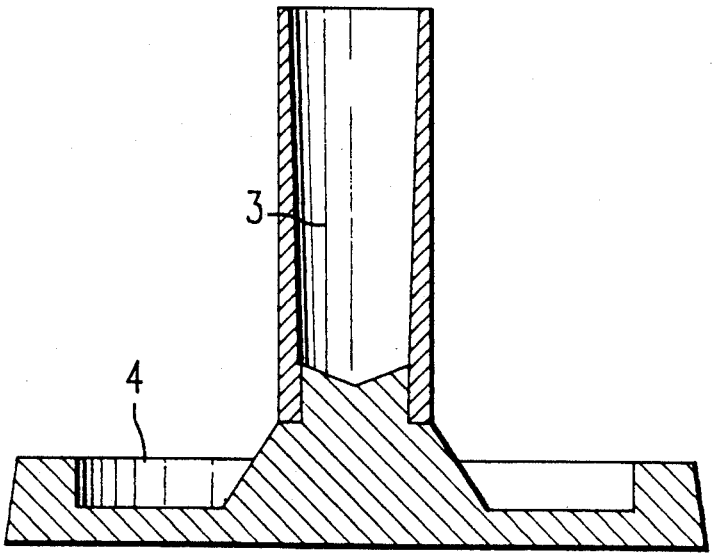
Figure 3:
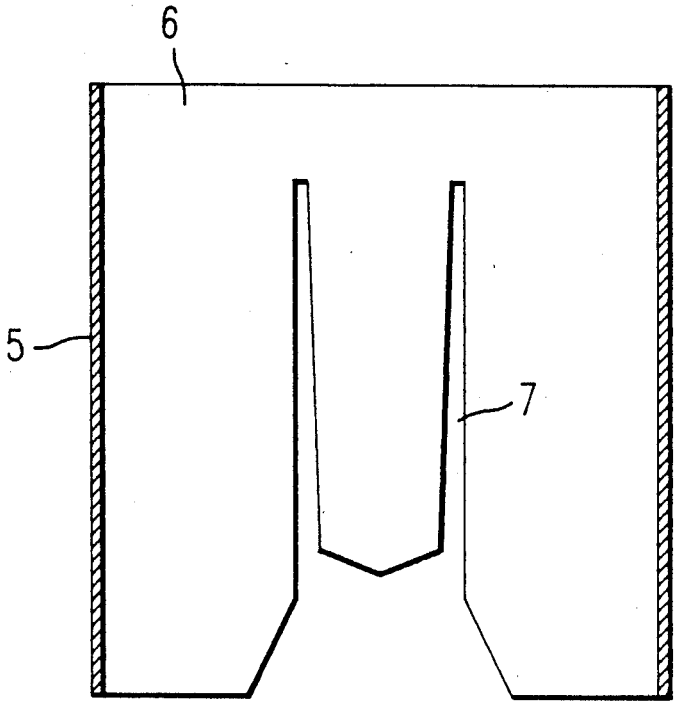
FIG. 3 is a cross sectional view of a flask and investment with a cavity formed after the removal of a semi-flexible base and subsequent evacuation of a tapered hollow cylindrical trunk.

A tapered wall thickness versus a uniform wall thickness, is the preferred embodiment for the current invention. Critical to the success of the metal casting process is the ability to introduce a molten metal into the complete tree cavity prior to the cooling and solidification of the metal. In either centrifugal or vacuum casting processes, the volume of molten metal flow as a function of time, initially into the trunk and subsequently into the jewelry pattern cavities, is determined primarily by orifice area at the base of the trunk where molten metal first enters the cavity. It is a desirable embodiment of the current invention to facilitate initial flow of molten metal into the cavity by increasing orifice area at the base of the trunk by increasing the wall thickness of the hollow cylinder 3 where it contacts the semi-flexible base 4 as can be seen in the cross sectional view of FIG. 2(*b*). Subsequent removal of the base after the investment has been made, followed by heating, melting and removal of the tapered hollow trunk, results in a configuration shown in FIG. 3 where a flask 5 is shown surrounding a solidified investment 6 and a tapered cavity 7.

Figure 4:
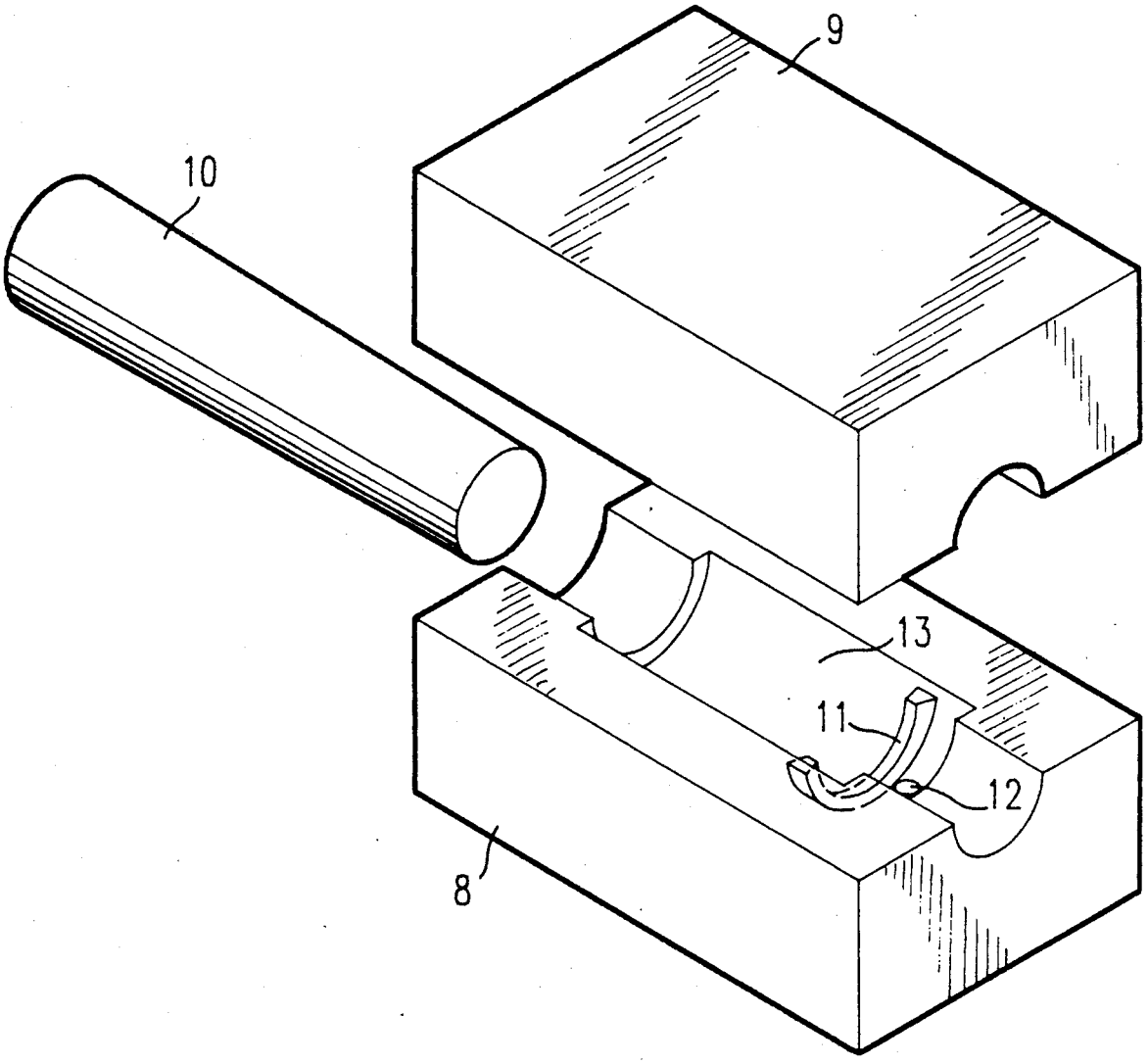
FIG. 4 is a perspective of a two piece mold and tapered cylindrical insert for the production of tapered hollow cylindrical wax or plastic tubes used as trunks in the Hollow Post Cylindrical Sprue Casting Method.

The hollow cylindrical trunk of the present invention, with a preferred tapered wall thickness, is manufactured by a low pressure injecting molding process with the two piece mold and insert shown in FIG. 4. Two mold halves 8 and 9, are closed and a tapered insert 10 is inserted into the mold. A molten wax or suitable plastic material is injected into the mold cavity via port 12. A gate 11 directs the material flow for improved filling of the main cavity 13.

The preferred method of the present invention to achieve a tapered wall thickness in the hollow cylindrical wax or plastic tube is to utilize a mold cavity whose diameter is constant to form a tube with a constant O.D., and an insert which is tapered to form a tube with a tapered I.D. An alternative, although not as desirable, is to utilize a cavity with a tapering diameter and an insert with a constant diameter, or, a cavity with a tapering diameter and an insert with a tapering diameter. The fit between a tapered insert and mold provides advantages of a close tolerance seal thus preventing any leakage of molten wax or plastic during injection and ease of removal of the insert from the tube after injection due to the draft of the taper.

Advantages realized by utilizing the present invention are:

1) by increasing the number of jewelry patterns of a tree, a reduction in the number of individual investments and castings which must be made to produce any given number of jewelry castings, can be achieved, thus reducing manufacturing labor costs of production.

2) Reducing the number of investments which must be made results in a corresponding reduction in investment materials usage and associated reduction in materials cost.

3) an improved ratio of metal mass in jewelry castings to trunk castings results in a reduction of metal volume from the trunk which must be remelted and refined when impurity levels reach an unacceptable level thus resulting in corresponding reduction in refining costs.

Having fully described this invention, it will be apparent to one of ordinary skill in the art that many changes and modifications can be made thereto without departing from the spirit of the invention as set forth herein.

What is claimed is:

1. A method of preparing a wax or plastic tree as a step in the manufacture of jewelry by the lost wax casting method, comprising:

forming a hollow tube by injection molding in a mold, said tube having a tapered wall thickness along substantially its entire length achieved by use of a tapered insert for said mold;

positioning said tube on a base, and attaching jewelry patterns to the tube.

2. The method of claim 1, wherein said base is rigid, flexible or semi-flexible.

3. The method of claim 2, wherein said base has a protrusion around which said tube is positioned.

4. The method of claim 2, wherein said base has an indentation into which said tube is positioned.

5. The method of claim 1, wherein jewelry patterns are attached to the tube by heating selected areas of at least one of the tube patterns and subsequently placing the tube and pattern in contact.

6. A method of preparing a wax or plastic tree as a step in the manufacture of jewelry by the lost wax casting method, comprising:

forming a hollow tube by injection molding in a mold cavity, said tube having a tapering wall thickness along substantially its entire length achieved by tapering said mold cavity in which said tube is formed:

positioning said tube on a base, and attaching jewelry patterns to said tube.

* * * * *